US007754143B2

(12) United States Patent
Qiao et al.

(10) Patent No.: US 7,754,143 B2
(45) Date of Patent: Jul. 13, 2010

(54) COBALT-RICH WEAR RESISTANT ALLOY AND METHOD OF MAKING AND USE THEREOF

(75) Inventors: Cong Yue Qiao, Menominee, MI (US); Daniel W. Bancroft, Menominee, MI (US)

(73) Assignee: L. E. Jones Company, Menominee, MI (US)

( * ) Notice: Subject to any disclaimer, the term of this patent is extended or adjusted under 35 U.S.C. 154(b) by 69 days.

(21) Appl. No.: 12/081,366

(22) Filed: Apr. 15, 2008

(65) Prior Publication Data

US 2009/0257906 A1 Oct. 15, 2009

(51) Int. Cl.

| | |
|---|---|
| ***C22C 38/30*** | (2006.01) |
| *C22C 38/52* | (2006.01) |
| *B21K 3/00* | (2006.01) |
| *F01L 1/00* | (2006.01) |
| *C21D 8/02* | (2006.01) |

(52) U.S. Cl. ..... 420/38; 29/688.01; 123/90.1; 148/542

(58) Field of Classification Search ..... 29/888.01; 123/90.1; 148/542; 419/30; 420/38
See application file for complete search history.

(56) References Cited

U.S. PATENT DOCUMENTS

| | | | | |
|---|---|---|---|---|
| 3,655,365 | A | 4/1972 | Holtz, Jr. | |
| 4,021,205 | A | 5/1977 | Matsuda et al. | |
| 4,147,538 | A * | 4/1979 | Yajima et al. | 75/229 |
| 4,204,887 | A | 5/1980 | Masumoto et al. | |
| 4,353,742 | A | 10/1982 | Crook | |
| 4,363,660 | A | 12/1982 | Wakita et al. | |
| 4,415,532 | A | 11/1983 | Crook | |
| 4,765,955 | A | 8/1988 | Yabuki et al. | |
| 4,880,481 | A | 11/1989 | Jerlich et al. | |

(Continued)

FOREIGN PATENT DOCUMENTS

| | | |
|---|---|---|
| GB | 678449 | 9/1985 |

OTHER PUBLICATIONS

ASM Handbooks Online. "Co-Cr-Fe ternary phase diagram." Alloy Phase Diagrams vol. 3 1992.*

(Continued)

*Primary Examiner*—Roy King
*Assistant Examiner*—Alexander Polyansky
(74) *Attorney, Agent, or Firm*—Buchanan Ingersoll & Rooney PC

(57) ABSTRACT

A cobalt-rich wear resistant and corrosion resistant alloy comprises in weight %, 0.5 to 1.2% C, 0.6 to 2.1% Si, 17 to 24% Cr, 27 to 38.5% Fe, 1.4 to 20% W, 3.8 to 9.7% Mo, less than 1% Ni and balance Co. A preferred cobalt-rich alloy comprises in weight %, 0.5 to 0.9 C, 0.75 to 1.15% Si, 17.5 to 20.5 Cr, 27.0 to 32.0 Fe, 12.5 to 16.5 W, 6.25 to 8.25 Mo, 0.45 to 1.00 Ni and balance Co. The alloy preferably has a microstructure free of primary carbides and comprises up to about 50% by volume eutectic reaction phases in a solid solution matrix. The solid solution matrix is an αFe-αCo face-centered cubic solution with W, Cr and Mo as solute elements and the eutectic reaction products comprise a $(Co,Cr)_7(W,Mo)_6$ phase and an αFe-αCo phase. The alloy is useful as a valve seat insert for internal combustion engines such as diesel engines.

19 Claims, 4 Drawing Sheets

U.S. PATENT DOCUMENTS

| | | | |
|---|---|---|---|
| 4,911,768 | A | 3/1990 | Dong et al. |
| 5,958,332 | A | 9/1999 | Hoeg |
| 6,200,688 | B1 | 3/2001 | Liang et al. |
| 6,254,660 | B1 | 7/2001 | Bernard et al. |
| 6,305,666 | B1 | 10/2001 | Sakai |
| 6,318,327 | B1 | 11/2001 | Takahashi et al. |
| 6,436,338 | B1 | 8/2002 | Qiao |
| 6,482,275 | B1 | 11/2002 | Qiao |
| 6,485,678 | B1 | 11/2002 | Liang et al. |
| 6,519,847 | B1 | 2/2003 | Trudeau et al. |
| 6,676,724 | B1 | 1/2004 | Narasimhan et al. |
| 6,702,905 | B1 | 3/2004 | Qiao et al. |
| 6,866,816 | B2 | 3/2005 | Liang et al. |
| 6,958,084 | B2 | 10/2005 | Whitaker et al. |
| 7,235,116 | B2 | 6/2007 | Rodrigues et al. |
| 2002/0020384 | A1 | 2/2002 | Hoeg |
| 2008/0001115 | A1 | 1/2008 | Qiao et al. |

OTHER PUBLICATIONS

International Search Report and Written Opinion dated Dec. 6, 2007 for International Application No. PCT/US07/14840.

Wear Testing Report, vol. 2, Issue 7, Newsletter Date: May 29, 2007, L.E. Jones Company.

Wear Testing Report, vol. 2, Issue 8, Newsletter Date: Jul. 7, 2007, L.E. Jones Company.

L.E. Jones Company, Precision Valve Seat Inserts, Technology, Alloy Specification, http://www.lejones.com/alloy_specifications.html, Oct. 15, 2008, pp. 1-4.

International Search Report and Written Opinion mailed Dec. 14, 2009 for PCT/US2009/002310.

* cited by examiner

COBALT-RICH WEAR RESISTANT ALLOY AND METHOD OF MAKING AND USE THEREOF

BACKGROUND

More restrictive exhaust emissions laws for diesel engines have driven changes in engine design including the need for high-pressure electronic fuel injection systems. Engines built according to the new designs use higher combustion pressures, higher operating temperatures and less lubrication than previous designs. Components of the new designs, including valve seat inserts (VSI), have experienced significantly higher wear rates. Exhaust valve seat inserts and valves, for example, must be able to withstand a high number of valve impact events and combustion events with minimal wear (e.g., abrasive, adhesive, and corrosive wear). This has motivated a shift in materials selection toward materials that offer improved wear resistance relative to the valve seat insert materials that have traditionally been used by the diesel industry.

Another emerging trend in diesel engine development is the use of EGR (exhaust gas recirculation). With EGR, exhaust gas is routed back into the intake air stream to reduce nitric oxide ($NO_x$) content in exhaust emissions. The use of EGR in diesel engines can raise the operating temperatures of valve seat inserts. Accordingly, there is a need for lower cost exhaust valve seat inserts having good mechanical properties including hot hardness for use in diesel engines using EGR.

Also, because exhaust gas contains compounds of nitrogen, sulfur, chlorine, and other elements that potentially can form acids, the need for improved corrosion resistance for alloys used in exhaust valve seat insert applications is increased for diesel engines using EGR. Acid can attack valve seat inserts and valves leading to premature engine failure.

SUMMARY

A cobalt-rich wear resistant and corrosion resistant alloy comprises in weight %, 0.5 to 1.2% C, 0.6 to 2.1% Si, 17 to 24% Cr, 27 to 38.5% Fe, 1.4 to 20% W, 3.8 to 9.7% Mo, less than 1% Ni and balance Co. In a preferred embodiment, the cobalt-rich alloy comprises in weight %, 0.5 to 0.9% C, 0.75 to 1.15% Si, 17.5 to 20.5% Cr, 27.0 to 32.0% Fe, 12.5 to 16.5% W, 6.25 to 8.25% Mo, 0.45 to 1.00% Ni and balance Co.

The alloy preferably has a microstructure free of primary carbides and preferably comprises up to about 50% by volume eutectic reaction phases in a solid solution matrix. The solid solution matrix is an αFe-αCo face-centered cubic solid solution with W, Cr and Mo as solute elements and the eutectic reaction phases comprise a $(Co, Cr)_7(W,Mo)_6$ phase and an αFe-αCo phase.

A valve seat insert comprises, in weight %, 0.5 to 1.2% C, 0.6 to 2.1% Si, 17 to 24% Cr, 27 to 38.5% Fe, 1.4 to 20% W, 3.8 to 9.7% Mo, less than 1% Ni and balance Co. In a preferred embodiment, the valve seat insert comprises in weight %, 0.5 to 0.9% C, 0.75 to 1.15% Si, 17.5 to 20.5% Cr, 27.0 to 32.0% Fe, 12.5 to 16.5% W, 6.25 to 8.25% Mo, 0.45 to 1.00% Ni and balance Co.

The valve seat insert can be a casting with an as-cast hardness from about 47 to about 53 Rockwell C, a compressive yield strength from about 105 ksi to about 115 ksi at room temperature; and/or a compressive yield strength from about 70 ksi to about 90 ksi at 1000° F. Preferably, the valve seat insert exhibits an ultimate tensile rupture strength from about 85 ksi to about 95 ksi at room temperature; an ultimate tensile rupture strength from about 75 ksi to about 85 ksi at about 1000° F.; a dimensional stability of less than about $0.25\times10^{-3}$ inches per inch of insert outside diameter (O.D.) after about 20 hours at about 1200° F.; an HV10 Vickers hardness from about 465 HV10 at room temperature to about 310 HV10 at 1000° F.; and/or a decrease in hardness of 40% or less when heated from about room temperature to about 1000° F.

A method of operating an internal combustion engine is provided. In operating an internal combustion engine such as a diesel engine, a valve is closed against the valve seat insert to close a cylinder of the internal combustion engine and the fuel is ignited in the cylinder to operate the internal combustion engine. The valve is preferably composed of a high-temperature, nickel-chromium alloy strengthened by precipitation hardening; or a high-temperature, nickel-based superalloy; or the valve is hard-faced with a high-temperature, wear-resistant cobalt-based alloy strengthened by carbides; or is hard-faced with a high-temperature, wear-resistant cobalt-based alloy strengthened by Laves phases.

A method of making a cobalt-rich wear resistant and corrosion resistant alloy as described above is provided. The alloy can be cast from a melt at a temperature from about 2750° F. to about 3000° F.; or formed into a shaped component by powder metallurgy. In a preferred embodiment, the alloy is cast from a melt at a temperature from about 2875° F. to about 2915° F. and further heat treated at a temperature from about 1300° F. to about 1500° F. for about 2 to about 10 hours in an inert, oxidizing, reducing atmosphere or in a vacuum.

DETAILED DESCRIPTION

Figure 1:
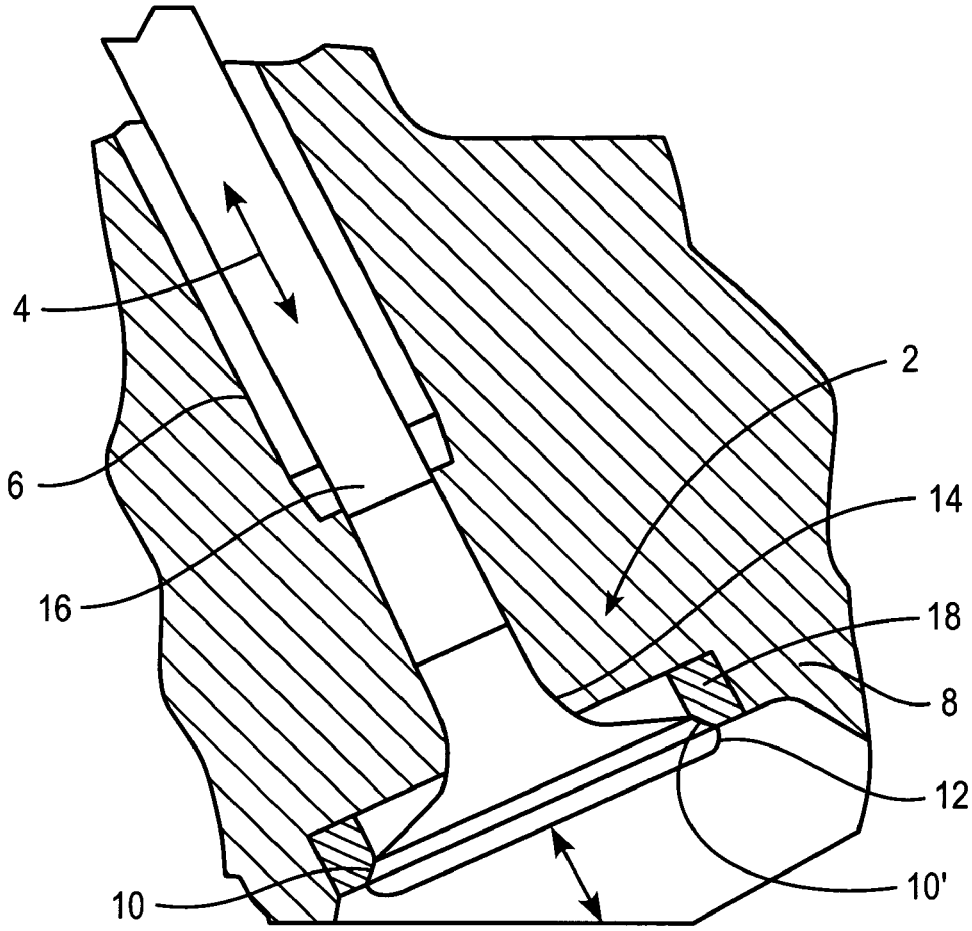
FIG. 1 is a cross-sectional view of a valve assembly incorporating a valve seat insert of a cobalt-rich alloy (referred to herein as the J17 alloy).

FIG. 1 illustrates an exemplary engine valve assembly 2. Valve assembly 2 includes a valve 4, which is slideably supported within the internal bore of a valve stem guide 6. The valve stem guide 6 is a tubular structure that fits into the cylinder head 8. Arrows illustrate the direction of motion of the valve 4. Valve 4 includes a valve seat face 10 interposed between the cap 12 and neck 14 of the valve 4. Valve stem 16 is positioned above neck 14 and is received within valve stem guide 6. A valve seat insert 18 having a valve seat insert face 10' is mounted, such as by press-fitting, within the cylinder head 8 of the engine. The cylinder head usually comprises a casting of cast iron, aluminum or an aluminum alloy. Preferably, the insert 18 (shown in cross section) is annular in shape and the valve seat insert face 10' engages the valve seat face 10 during movement of valve 4.

While cobalt-based alloys have been used for manufacturing valve seat insert 18, due to the high temperature wear resistance and compressive strength of such alloys, a major disadvantage of such cobalt-based alloys is their relatively high cost. Commercially available wear resistant cobalt-based alloys for heavy-duty engine valve-train applications such as valve seat insert 18, include STELLITE 3® (i.e., a high temperature, wear-resistant cobalt-based alloy strengthened by primary carbides) and TRIBALOY T-400® (i.e., a high temperature, wear-resistant cobalt-based alloy strengthened by Laves phases).

STELLITE 3® alloy is strengthened through the formation of chromium-rich carbides ($M_7C_3$) and tungsten-rich carbides ($M_6C$) in a soft matrix (i.e., face-centered cubic cobalt solid solution). The mechanical properties of the STELLITE 3® alloy depend on the size, amount and distribution of the primary chromium rich carbides. Moreover, the physical, mechanical, and metallurgical properties of STELLITE 3® are non-isotropic. However, because valve seat inserts are cast, the distribution of the chromium-rich carbides is dependent upon the cooling conditions during the solidification process.

Due to increasingly harsh internal combustion engine and/or more restrictive emission requirements, valve seat inserts made from cobalt-based STELLITE 3® alloy can exhibit insufficient wear resistance when paired with high performance nickel-based valve materials and cobalt-based hardfacing materials. Localized mechanical properties of STELLITE 3® are significantly related to the bond strength between the carbides and soft matrix. However, because of incoherent interfaces between the carbides and matrix, a lower bonding strength between the two phases is expected. Under valve-train operational conditions, deformation of the soft matrix has been observed. Additionally, carbides can rupture due to low bending toughness and insufficient support from the matrix. Rupturing of the primary carbides can result in a degradation of contact surface conditions between valve and valve seat insert during service. Accordingly, for some valve-train applications, the use of STELLITE® alloys may be less than satisfactory.

Cobalt-based TRIBALOY T-400® alloy, which has a significantly lower carbon content than STELLITE 3® alloy, is strengthened through the formation of molybdenum-rich intermetallic Laves phases. The mechanical properties, wear resistance properties, and corrosion resistant properties are related to the bonding between the cobalt matrix and the cobalt-chromium-molybdenum phase. However, because the cobalt content is over 50% and the molybdenum content is over 25%, widespread application of TRIBALOY T-400® for heavy-duty engine valve-trains may be cost prohibitive. For example, the cost of TRIBALOY T-400® alloy can be about 50% to about 80% higher than STELLITE 3® alloy. Thus, a need exists for a more cost effective cobalt alloy with adequate wear resistant properties and corrosion resistant properties.

Disclosed herein is a novel cobalt-rich alloy system (referred to herein as "J17 alloy") for valve-train material applications, preferably internal combustion valve seat inserts. The low carbon content (≦1.2 weight % C) of the alloy prevents formation of a primary carbide phase and promotes intermetallic interaction between the chromium, iron, tungsten and cobalt during casting. This intermetallic bonding promotes wear resistance and corrosion resistance, two desired characteristics for valve seat inserts for low emission natural and diesel gas engines. The J17 alloy also exhibits similar corrosion resistance properties as other corrosion resistant alloys with higher cobalt content (e.g., TRIBALOY T-400® or STELLITE 3®), but at a lower cost, due to the reduction in cobalt content. Thus, the J17 alloy system is a lower cost alternative to STELLITE 3® or TRIBALOY T-400® for valve seat insert applications.

The J17 cobalt alloy comprises, in weight percent, 0.5 to 1.2% C, 0.6 to 2.1% Si, 17 to 24% Cr, 27 to 38.5% Fe, 1.4 to 20% W, 3.8 to 9.7% Mo, less than 1% Ni and balance Co. In a preferred embodiment, the J17 alloy preferably comprises, in weight percent, 0.5 to 0.9% C, 0.75 to 1.15% Si, 17.5 to 20.5% Cr, 27.0 to 32.0% Fe, 12.5 to 16.5% W, 6.25 to 8.25% Mo, 0.45 to 1.00% Ni and the balance including Co and incidental impurities. The J17 alloy can also contain up to 1.5 weight % each of Ti, Al, Zr, Hf, Ta, V, Nb or Cu and/or up to 0.5% each of Mg, B or Y. The J17 alloy, due to its low carbon content and alloy system, is free of primary carbides and characterized by intermetallic interaction between the Co, Cr, W and Mo alloying elements.

Silicon can significantly affect castability and melting temperature of the J17 alloy. Silicon can also form several types of intermetallic phases with cobalt. An increase in the silicon content in cobalt from 0 to 5 weight % can decrease the melting temperature of the cobalt-silicon system by more than 200° F. It has been determined that silicon has a greater influence on mechanical properties for the J17 alloy with a hardness of about 45 or more on the Rockwell Hardness scale C (i.e., ≧45 HRC). Thus, to achieve desirable castability and hardness, the silicon content in the J17 alloy is preferably controlled at a narrow range from about 0.75 weight % to about 1.15 weight %. To obtain optimal mechanical properties and castability, the silicon to cobalt ratio should be from about 0.025 to about 0.035 in the J17 alloy.

Carbon can have a significant effect on microstructural distribution, mechanical properties, corrosion resistance, and castability of the J17 alloy. When the carbon content of the J17 alloy exceeds 1.2 weight %, primary carbides and carbonitrides have a tendency to form in the cast component. The presence of primary carbides and carbonitrides in the microstructure can adversely affect corrosion resistance and wear resistance properties. However, when the carbon content is less than 0.5 weight %, bulk hardness of the J17 alloy can be reduced. Thus, for optimal corrosion resistance, wear resistance and mechanical properties, the carbon content of the J17 alloy is preferably from about 0.5 weight % to about 0.9 weight %.

Iron is a matrix material of the J17 alloy and iron concentration can significantly affect the matrix composition distribution and metallic phase formation and distribution. It has been determined that for optimal microstructure, castability and mechanical properties, the iron to cobalt ratio should be from about 0.7 to about 1.1, preferably from about 0.82 to about 1.07.

Nickel exhibits complete solubility with cobalt, however, nickel has a higher tendency to react with other alloying elements, such as silicon, thus influencing microstructure. For optimal microstructure, castability and mechanical properties, the nickel content of the J17 alloy is preferably from about 0.45 weight % to about 1.00 weight %.

The J17 alloy is dimensionally stable from ambient to about 1200° F. Furthermore, the J17 alloy exhibits a good combination of mechanical properties, such as toughness, bulk hardness, compression yield strength, tensile rupture strength, and radial crush rupture toughness. The hardness of the J17 alloy can vary from about 47 HRC to about 53 HRC.

The wear resistance of J17 alloy, when used with nickel-based valve materials (i.e., NIMONIC®, a high-temperature, nickel-chromium alloy strengthened by precipitation hardening; or INCONEL®, a high-temperature, nickel-based superalloy), exhibited an overall improvement in wear at elevated service temperatures of between about 200° C. and about 500° C. in comparison to STELLITE 3®. Moreover, the J17 alloy exhibits similar corrosion resistance properties to STELLITE 3®.

The J17 alloy system is also softer and tougher than STELLITE 3® or TRIBALOY T-400®, providing for more cost effective machining and a valve-train component that is less susceptible to cracking during manufacturing. The machining of harder materials increases costs associated with more expensive tool grades, reduced tool life and increased downtime for tool replacement. Harder, more brittle alloys may potentially cause cracking, resulting in a need for further inspection of the finished component. In addition to reducing manufacturing costs, a softer alloy material for a valve seat insert can also reduce overall wear of the valve and provide a more conformable and faster attainment of surface-to-surface contact (e.g., between the valve seat face 10 and valve seat face insert 10') than harder materials during engine break-in. The ability of a softer insert material to quickly conform and establish surface contact can reduce interfacial stress, thus reducing the overall wear of the valve.

Evaluation of Castability

Twenty-nine trials of J17 experimental heats (i.e., 60 pound lots) were fabricated to evaluate castability of the alloy, summarized in TABLES 1-5. The J17 alloy can be compositionally adjusted to optimize castability. The influence of alloying elements were investigated in terms of molten metal flow rate, casting shrinkage sensitivity and gas porosity sensitivity.

In Trials 1-8, the effects of carbon content, silicon content and casting temperature on the hardness and castability of a Co—Fe—W alloy matrix system were determined (chromium and molybdenum were not added to the alloy). As described above, silicon and carbon content can affect castability of a cobalt alloy. The results of Trials 1-8 are summarized in TABLE 1 (wherein C, Si, Cr, Fe, W, Mo and Co contents are in weight %). A good casting is characterized by molten metal fluidity, casting shrinkage resistance and gas porosity resistance. If the pour temperature is too low or too high, the casting suffered from shrinkage upon solidification. One characteristic of a poor castability is the inability to completely fill the casting cavities. Depending on the geometry and dimensions of the mold, the casting temperature can be optimized in the temperature range from about 2800° F. to about 3000° F., to minimize porosity of the final casting.

Trials 1-4 illustrated that higher carbon contents (i.e., >1.2 weight % C) resulted in brittle castings. Trial 1 was the first alloy composition which exhibited poor castability at a pouring temperature of about 2800° F. The alloy composition included 2.72 weight % C which formed primary carbides in a brittle casting with an HRC value of 60.7.

In Trial 2, the carbon content was reduced to 1.20 weight % C. However, despite the lower carbon content, the casting of Trial 2 resulted in a brittle casting with an HRC value of 62. Additionally, due to the relatively low pouring temperature of about 2800° F. in Trial 2, the mold cavities were not properly filled.

In Trial 3, the carbon content was further reduced to 0.62 weight %. This casting exhibited substantially fewer primary carbides, which increased toughness of the casting. However, because of the relatively low pouring temperature of about 2800° F., mold cavities were not properly filled.

In Trial 4, the carbon content was further reduced to 0.5 weight % C with 0.73 weight % Si. The lower carbon content of Trial 4 resulted in an increase in toughness of the casting. However, due to the lower Si content of 0.73 weight % and pouring temperature of 2850° F., there was no improvement in casting cavity fill.

Trial 5 and Trial 6 illustrated that increasing the pouring temperature to 2877° F. improved castability. In Trial 5, an alloy composition with 1.5 weight % Si, with a slightly higher pouring temperature of 2877° F. resulted in mold cavity fill, low gas porosity susceptibility and low shrinkage tendency. In Trial 6, an alloy composition of 0.5 weight % Si with similar pouring conditions produced similar castability. It was determined that a pouring temperature above 2875° F. was required for proper mold cavity fill.

Trial 7 and Trial 8 illustrated that at a slightly higher pouring temperature of 2915° F., good castability in terms of molten metal fluidity, casting shrinkage resistance and gas porosity resistance could be achieved.

Trials 9-11 illustrate that a reduction in tungsten content in the castings from about 30 weight % W to about 20% W did not significantly influence the hardness values. The results of Trials 9-11 are summarized in TABLE 2 (wherein C, Si, Cr, Fe, W, Mo and Co contents are in weight %). As illustrated in TABLE 2, the hardness values ranged from about 47.5 HRC to about 50.6 HRC.

TABLE 1

| Trial | Heat | C | Si | Cr | Fe | W | Mo | Co | HRC | Pour Temp. (° F.) | Castability |
|---|---|---|---|---|---|---|---|---|---|---|---|
| 1 | 5E17XA | 2.72 | 1.00 | 0.00 | 35 | 30 | 0.00 | 31 | 60.7 | 2800 | Poor |
| 2 | 5E18XA | 1.20 | 2.10 | 0.00 | 35 | 30 | 0.00 | 31 | 62 | 2800 | Poor |
| 3 | 5E19XA | 0.62 | 0.86 | 0.00 | 35 | 30 | 0.00 | 31 | 57.6 | 2800 | Poor |
| 4 | 5E20XA | 0.54 | 0.73 | 0.00 | 35 | 30 | 0.00 | 31 | 53.6 | 2850 | Poor |
| 5 | 5E20XB | 0.53 | 1.50 | 0.00 | 35 | 30 | 0.00 | 31 | 56.3 | 2877 | Good |
| 6 | 5E23XA | 0.55 | 0.70 | 0.00 | 35 | 30 | 0.00 | 31 | 54.3 | 2877 | Good |
| 7 | 5E27XA | 0.47 | 0.66 | 0.00 | 35 | 30 | 0.00 | 31 | 48.5 | 2915 | Good |
| 8 | 5F01XA | 0.45 | 0.94 | 0.00 | 35 | 30 | 0.00 | 31 | 45.5 | 2915 | Good |

TABLE 2

| Trial | Heat | C | Si | Cr | Fe | W | Mo | Co | HRC |
|---|---|---|---|---|---|---|---|---|---|
| 9 | 5F07XA | 0.63 | 1.00 | 0.00 | 38.5 | 19.81 | 0.00 | 38.5 | 47.5 |
| 10 | 5F09XA | 0.60 | 1.10 | 0.00 | 38.5 | 19.94 | 0.00 | 38.5 | 50.6 |
| 11 | 5F13XA | 0.43 | 1.00 | 0.00 | 38.5 | 19.23 | 0.00 | 38.5 | 48.0 |

Trials 12-17 illustrate the influence of tungsten content in a Co—Fe—Cr—W alloy composition with a target chromium content of 21 weight %. The results of Trials 12-17 are summarized in TABLE 3. As shown in TABLE 3 (wherein C, Si, Cr, Fe, W, Mo and Co contents are in weight %), an increase in tungsten from 0 to about 9 weight % resulted in the hardness of the casting increasing from about 26.5 HRC to about 38.9 HRC. It should be noted that the alloy of Trial 16 contains a higher amount of carbon (0.93 weight %), resulting in the highest hardness value of 41.3 HRC.

TABLE 3

| Trial | Heat | C | Si | Cr | Fe | W | Mo | Co | HRC |
|---|---|---|---|---|---|---|---|---|---|
| 12 | 5F15XA | 0.43 | 1.20 | 22.34 | 38.5 | 0.00 | 0.00 | 38.5 | 26.5 |
| 13 | 5F20XA | 0.39 | 1.20 | 23.00 | 37.5 | 1.40 | 0.00 | 37.5 | 24.8 |
| 14 | 5F21XA | 0.71 | 1.14 | 22.26 | 35.0 | 6.61 | 0.00 | 35.0 | 34.7 |
| 15 | 5F22XA | 0.50 | 1.20 | 22.36 | 35.0 | 6.63 | 0.00 | 35.0 | 28.1 |
| 16 | 5F23XA | 0.93 | 1.10 | 21.40 | 33.0 | 8.69 | 0.00 | 35.0 | 41.3 |
| 17 | 5F28XA | 0.62 | 1.34 | 21.81 | 33.0 | 8.81 | 0.00 | 35.0 | 38.9 |

In Trials 18-21, the influence of carbon content in a 33Co-31 Fe-23Cr-11W alloy composition was determined. The results of Trials 18-21 are summarized in TABLE 4. As shown in TABLE 4 (wherein C, Si, Cr, Fe, W, Mo and Co contents are in weight %), the hardness values varied from about 38.6 HRC to about 44.0 HRC when the carbon content was varied from 0.5 weight % to 0.9 weight % for a target 33Co-31Fe-23Cr-11W alloy composition.

TABLE 4

| Trial | Heat | C | Si | Cr | Fe | W | Mo | Co | HRC |
|---|---|---|---|---|---|---|---|---|---|
| 18 | 5F30XA | 0.50 | 1.27 | 22.34 | 31.00 | 10.23 | 0.00 | 33.00 | 38.6 |
| 19 | 5G01XA | 0.81 | 1.37 | 23.94 | 30.60 | 10.18 | 0.00 | 33.00 | 44.0 |
| 20 | 5G12XA | 0.51 | 1.13 | 23.14 | 30.78 | 10.56 | 0.00 | 33.00 | 41.2 |
| 21 | 5G14XA | 0.84 | 1.11 | 23.60 | 31.00 | 10.27 | 0.00 | 33.00 | 42.4 |

In Trials 22-27, the alloying effects of molybdenum content in a 31Co-28 Fe-19Cr-13W-1.25Si-0.75C alloy composition were determined. In Trials 28 and 29, two heats of the J17 alloy were cast to verify castability of the preferred composition. The results of Trials 22-29 are summarized in TABLE 5. As shown in TABLE 5 (wherein C, Si, Cr, Fe, W, Mo and Co contents are in weight %), the hardness values varied from about 41.1 HRC to about 58.1 HRC when the molybdenum content was increased from 0 weight % to 9.7 weight % for a 31Co-28 Fe-19Cr-13W-1.25Si-0.75C alloy composition. It was determined that with about 7.0 weight % Mo, the target hardness of about 50 HRC was achieved.

TABLE 5

| Trial | Heat | C | Si | Cr | Fe | W | Mo | Co | HRC |
|---|---|---|---|---|---|---|---|---|---|
| 22 | 5G19XA | 0.69 | 0.87 | 20.50 | 31.00 | 13.32 | 0.00 | 33.00 | 41.1 |
| 23 | 5H03XA | 0.61 | 0.93 | 20.86 | 30.00 | 10.16 | 3.79 | 32.00 | 46.5 |
| 24 | 5H03XB | 0.78 | 1.10 | 20.35 | 29.00 | 10.58 | 6.22 | 31.00 | 50.0 |
| 25 | 5H03XC | 0.75 | 1.19 | 20.06 | 28.00 | 9.73 | 8.73 | 31.00 | 53.0 |
| 26 | 5H09XA | 0.74 | 1.01 | 20.68 | 28.00 | 6.81 | 9.70 | 31.00 | 58.1 |
| 27 | 6H03XA | 0.52 | 1.94 | 21.47 | 28.00 | 15.75 | 7.95 | 31.00 | 50.0 |
| 28 | 6H10XA | 0.72 | 0.80 | 19.54 | 28.00 | 16.37 | 7.54 | 31.00 | 50.8 |
| 29 | 6H10XB | 0.72 | 0.80 | 19.48 | 28.00 | 16.02 | 7.29 | 31.00 | 51.4 |

Evaluation of Microstructure

Figure 2:
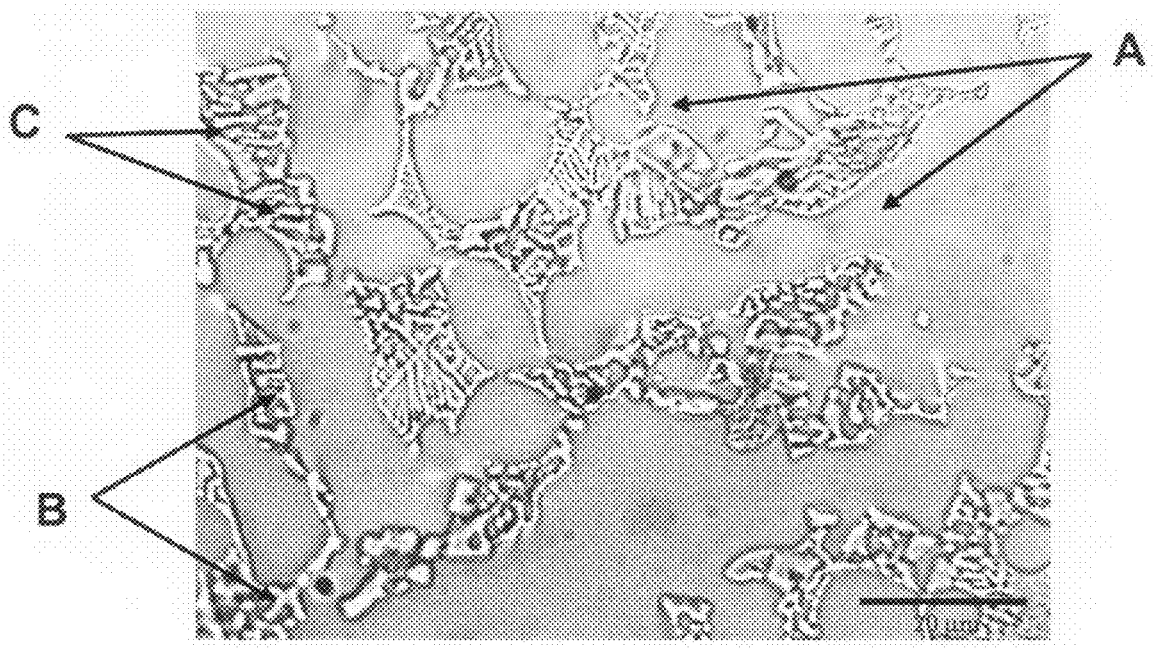
FIG. 2 is an optical micrograph of the J17 alloy in the as-cast condition.
Figure 3:
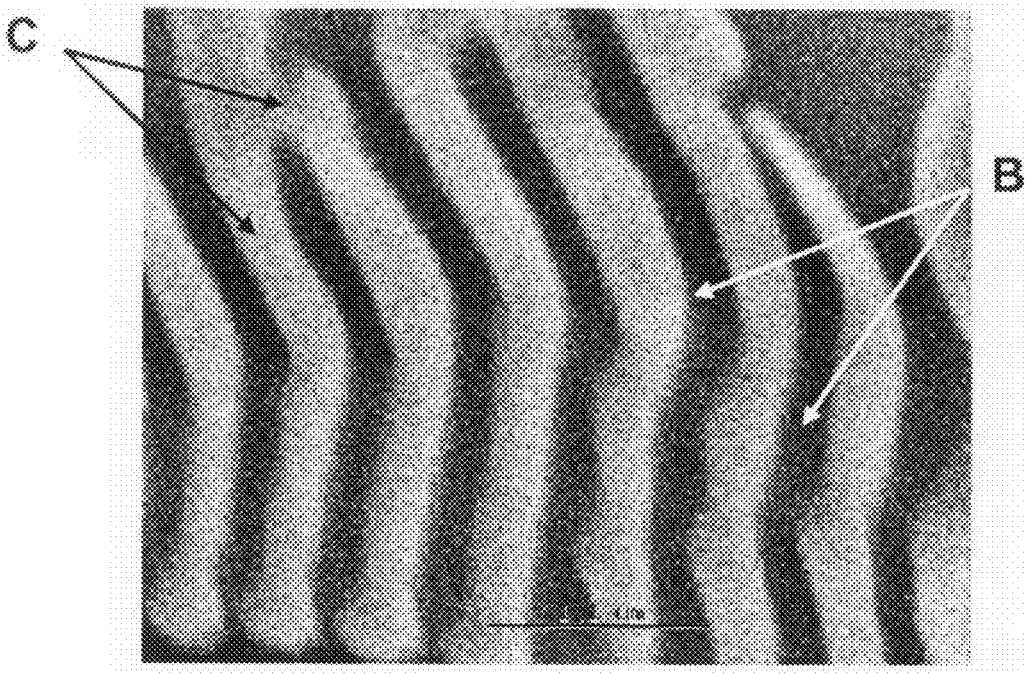
FIG. 3 is a scanning electron microscopy micrograph of the J17 alloy in the as-cast condition.

FIGS. 2 and 3 illustrate the microstructural morphology of an embodiment of the as-cast J17 alloy (Trial 26 from TABLE 5). The microstructure of the as-cast J17 alloy can be characterized as a cobalt-rich alloy free of primary carbides composed of eutectic reaction phases, including intermetallic phases in a solid solution face-centered cubic matrix.

In general terms, the microstructure of the J17 alloy system can be analyzed using a Co—Fe—Cr ternary component phase diagram. During the solidification process, the matrix initially solidifies to form a γFe-αCo solid solution phase with W, Cr, and Mo solute elements. The predominant solidification substructural morphology of the solid solution phase is coarse cellular dendritic. The γFe-αCo phase transforms to αFe-αCo when the metal temperature decreases to approximately 1000° C.

Below 1000° C., the crystal structure of αCo can be defined by the Pearson Symbol of cF4 and Space Group of $Fm\bar{3}m$ (FCC). As such, the J17 alloy possesses an FCC matrix and is non-magnetic at room temperature. The J17 alloy matrix possesses good mechanical strength, due to significant solid solution strengthening mechanisms from both interstitial and substitution alloying elements.

FIG. 2 is an optical micrograph of an electrolytically etched as-cast J17 alloy. The solid solution phase of the microstructure (designated as Region A in FIG. 2) is 40% to 60% by volume, preferably about 50% by volume of the material. The interdendritic region of J17 (designated as Region B and Region C in FIG. 2) exhibits the eutectic reaction products. Cobalt can form eutectic reactions with C, Cr, and W. In addition, carbon can form eutectic reactions with majority of the elements involved in J17 alloy.

FIG. 3 is a scanning electron microscopy (SEM) micrograph illustrating an enlarged view of the eutectic region in FIG. 2 (Regions B and C). The primary eutectic reaction phases were determined to be $(Co, Cr)_7(W,Mo)_6$ (white phase in Region B) and αFe-αCo (dark phase or Region C), based on analysis of the phase diagram and SEM, electron dispersive spectroscopy (EDS) and transmission electron microscopy (TEM) analysis. The eutectic αFe-αCo phase (Region C) was determined to have a higher Fe content than the dendritic αFe-αCo phase in the solid solution.

From the FIGS. 2 and 3 micrographs, it should be noted that the J17 alloy microstructure is free of primary carbides, which was one of the fundamental design concepts for the J17 alloy. In addition, the J17 alloy is preferably free of strong MC type carbide formers such as Ti, V, Nb, and Ta. Therefore, only very small amounts of MC type carbides may exist in the matrix such as molybdenum, tungsten, and/or silicon type precipitation carbides if heat treatment is applied (e.g., for stress relief).

Based upon analysis of the twenty-nine experimental heats of J17 (summarized in TABLES 1-5), a full production sized heat was cast with the composition summarized in TABLE 6 (wherein C, Si, Cr, Fe, W, Mo contents are in weight %). Preferably, the as-cast hardness of the J17 alloy is from about 47 HRC to about 53 HRC.

TABLE 6

| Heat | C | Si | Cr | Fe | W | Mo | Co |
|---|---|---|---|---|---|---|---|
| 6I22R | 0.73 | 1.07 | 17.9 | 31.04 | 12.80 | 6.25 | Balance |

Thermal Expansion Coefficient Testing

Samples of the J17 alloy with the composition outlined in TABLE 6 were analyzed by dilatometry to obtain linear thermal expansion coefficient measurements. Testing was carried out in an argon atmosphere from ambient temperature to about 1000° C. For comparative purposes, other valve seat insert alloys, including a cobalt-based alloy (J3 or STELLITE 3®) and three nickel-based alloys (J89, J96 and J100) were also analyzed by dilatometry. All of the J-Series alloys are available from L.E. Jones Company, located in Menominee, Mich. The dilatometry samples had a cylindrical geometry, about 1 inch in length and about 0.5 inch in diameter. The linear thermal expansion coefficient measurements were conducted perpendicular to the primary directional solidification orientation for these alloys. The results of the dilatometry analysis are summarized in TABLE 7.

TABLE 7

| | Linear Thermal Expansion Coefficient ($\times 10^6$ mm/mm ° C.) | | | | | |
|---|---|---|---|---|---|---|
| Temperature (° C.) | J17 | J3 (Co-based | J89 (Ni-rich) | J96 (Ni-based) | J100 (Ni-based) | J130 (Fe-based) |
| 25 to 200 | 13.8 | 13.1 | 10.7 | 12.2 | 12.8 | 10.5 |
| 25 to 300 | 14.2 | 14.0 | 11.3 | 13.0 | 13.8 | 11.3 |
| 25 to 400 | 14.5 | 14.5 | 11.6 | 13.4 | 14.3 | 12.0 |
| 25 to 500 | 14.8 | 15.0 | 11.9 | 13.8 | 14.7 | 12.3 |
| 25 to 600 | 15.3 | 15.3 | 12.2 | 14.2 | 15.2 | 12.6 |

As illustrated in TABLE 7, the linear thermal expansion coefficient for the J17 alloy is nearly the same as the J3 alloy (cobalt-based alloy or STELLITE 3®) and the J100 alloy (nickel-based alloy containing cobalt).

Corrosion Resistance Testing

Samples of the J17 alloy with the composition outlined in TABLE 6 were evaluated for corrosion resistance using ASTM G5 (standard reference test method for making potentiostatic and potentiodynamic anodic polarization measurements) and ASTM G61 (standard test method for conducting potentiostatic and potentiodynamic measurements for localized corrosion susceptibility of iron-, nickel- or cobalt-based alloys). The acidified test solution was composed of sodium sulfate (7800 ppm $SO_4^{-2}$) and sodium nitrate (1800 ppm $NO_3^{-1}$). The pH of the solution was adjusted to between about 2.5 and about 3.0 with acetic acid (5 g/L). For comparative purposes, other valve seat insert alloys, including a cobalt-based alloy (J3 or STELLITE 3®), a nickel-based alloy (J96), a martensitic tool steel (J120V), a martensitic stainless steel (J125) and an iron-based alloy (J160), were also evaluated for corrosion resistance using ASTM G5 and ASTM G61. All of the J-Series alloys are available from L.E. Jones Company, located in Menominee, Mich. TABLE 8 summarizes corrosion test results and the electrochemical test behavior.

TABLE 8

| | J17 | J3 (Co-based) | J96 (Ni-based) | J120V (Steel) | J125 (Stainless) | J160 (Fe-based) |
|---|---|---|---|---|---|---|
| Corrosion Rate (mpy) | <0.1 | <0.1 | <0.1 | 263 | 11 | 65 |
| Behavior | Active/ Passive | Active/ Passive | Active/ Passive | Active | Active/ Passive | Active/ Passive |

As illustrated in TABLE 8, J17 alloy exhibited excellent corrosion resistance, comparable to the cobalt-based J3 alloy (or STELLITE 3®). Furthermore, the corrosion resistance of J17 alloy exhibited a substantial improvement over martensitic tool steel (J120V), martensitic stainless steel (J125) and an iron-based alloy (J160).

Compression and Tension Testing

Samples of the J17 alloy with the composition outlined in TABLE 6 were evaluated to determine compression strength and tensile strength for temperatures up to 1000° F. using ASTM E209-89a (2000) (standard test for compression strength, 0.2% yield strength) and ASTM E21-05 (standard test for ultimate tensile rupture strength). For comparative purposes other valve seat insert alloys, including a cobalt-based alloy (J3 or STELLITE 3®), a nickel-based alloy (J96), a martensitic tool steel (J120V) and two iron-based alloys (J130 and J160), were also evaluated for mechanical properties at elevated temperatures. The results for the compressive yield strength and ultimate tensile strength, both at elevated temperatures, are illustrated in FIGS. 4A and 4B respectively.

Figure 4A:
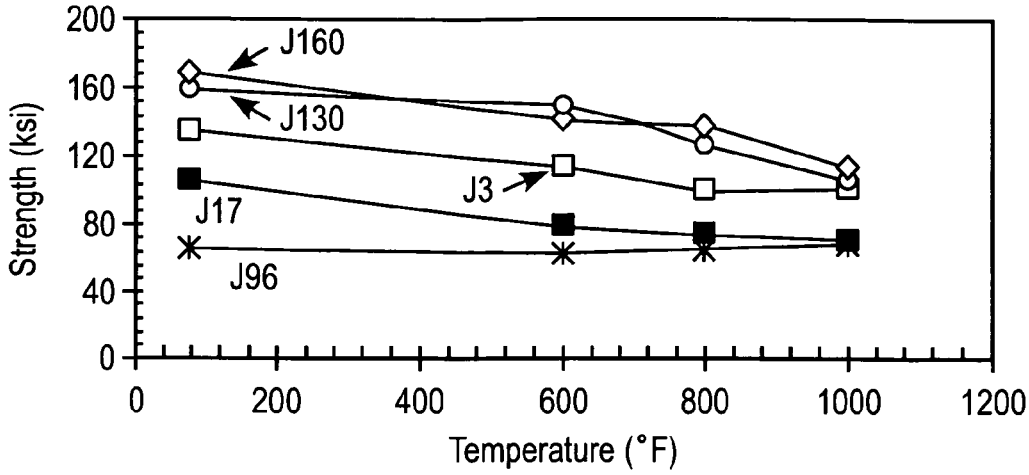
FIG. 4A illustrates compressive yield strength as a function of test temperature of the J17 alloy in comparison to other valve seat insert alloys.

From FIG. 4A, it has been determined that the J17 alloy exhibits compressive strength values between the compressive strength values for the cobalt-based alloy (J3 or STELLITE 3®) and the nickel based alloy (J96) for elevated temperatures up to 1000° F. Preferably, a valve seat insert of the J17 alloy exhibits a compressive yield strength from about 105 ksi to about 115 ksi at room temperature; and/or a compressive yield strength from about 70 ksi to about 90 ksi at 1000° F.

Figure 4B:
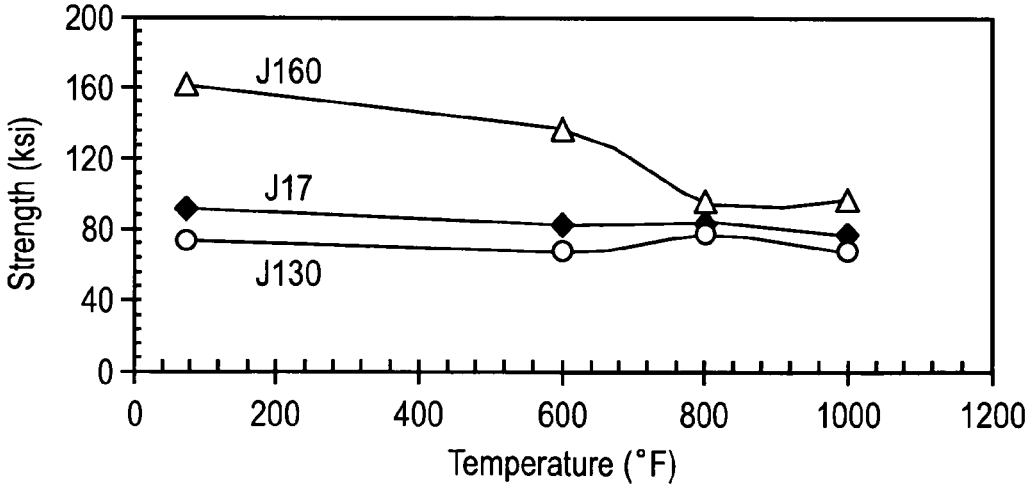
FIG. 4B illustrates ultimate tensile strength as a function of test temperature of the J17 alloy in comparison to other valve seat insert alloys.

From FIG. 4B, it has been determined that the J17 alloy exhibits ultimate tensile rupture strength values between the ultimate tensile rupture strength values for iron-based alloy J130 and iron-based alloy J160 at temperatures up to 1000° F. Preferably, a valve seat insert of the J17 alloy exhibits an ultimate tensile rupture strength from about 85 ksi to about 95 ksi at room temperature; and/or an ultimate tensile rupture strength from about 75 ksi to about 85 ksi at about 1000° F. These tests have determined that the J17 alloy possesses sufficient mechanical strength for valve seat insert applications.

Wear Resistance Evaluation

Samples of the J17 alloy with the composition outlined in TABLE 6 were evaluated for wear resistance up to 500° C. using ASTM G133-95 (standard test method for determining sliding wear of wear-resistant materials using a linearly reciprocating ball-on-flat geometry). High temperature reciprocating wear tests in a Plint Model TE77 Tribometer were carried out using reciprocating pin versus plate test. The testing condition included a 20 N applied load, a 20 Hz reciprocating frequency and a 1 mm stroke length at eleven test temperatures from 25° C. to 500° C. for 100,000 cycles. All tests were conducted in the laboratory atmosphere with dry test conditions (i.e., no lubrication).

In the wear tests, the reciprocating pin was made of the valve seat insert material, while the stationary plate was made of the valve material. Valve materials tested include nickel-based INCONEL-751®, nickel-based NIMONIC-80A®, cobalt-based STELLITE-6® hard-faced valve material, and cobalt-based TRIBALOY T-400® hard-faced valve material. Wear testing included two comparative cobalt-based valve seat insert materials, J3 (a valve seat insert alloy similar to STELLITE 3®) and J10 (a valve seat insert alloy similar to TRIBALOY T-400®) were also evaluated for mechanical properties at elevated temperatures.

TABLE 9A

| | Materials Test Pairs | | | | | | | | | | | |
|---|---|---|---|---|---|---|---|---|---|---|---|---|
| | J3/STELLITE-6 ® Materials Wear (mg) | | | J130/STELLITE-6 ® Materials Wear (mg) | | | J160/ STELLITE-6 ® Materials Wear (mg) | | | J17/STELLITE-6 ® Materials Wear (mg) | | |
| Temp (° C.) | Plate | Pin | Total | Plate | Pin | Total | Plate | Pin | Total | Plate | Pin | Total |
| 200 | 0.4 | 3.0 | 3.4 | 3.9 | 0.7 | 4.6 | 2.4 | 1.2 | 3.6 | 4.5 | 1.7 | 6.2 |
| 250 | 0 | 4.3 | 4.3 | 3.4 | 2.2 | 5.6 | 3.2 | 2.1 | 5.3 | 2.8 | 1.8 | 4.6 |
| 300 | 0.1 | 5.4 | 5.5 | 3.5 | 1.4 | 4.9 | 2.8 | 2.5 | 5.3 | 3.4 | 1.5 | 4.9 |
| 350 | 0.1 | 6.5 | 6.6 | 2.7 | 2.2 | 4.9 | 3.4 | 2.3 | 5.7 | 2.2 | 0.9 | 3.1 |
| 400 | 0.1 | 5.8 | 5.9 | 1.2 | 0.8 | 2.0 | 2.0 | 2.0 | 4.0 | 1.0 | 0.7 | 1.7 |
| 450 | 0 | 5.9 | 5.9 | 0.6 | 0 | 0.6 | 1.0 | 1.6 | 2.6 | 0.8 | 0.4 | 1.2 |
| 500 | 0.1 | 4.0 | 4.1 | 0 | 0 | 0 | 1.0 | 0.1 | 1.1 | 0.9 | 0.3 | 1.2 |

As illustrated in TABLE 9A, the J17/STELLITE-6® materials pair exhibited improved wear resistance in comparison to the J3/STELLITE-6® materials pair in the 300° C. to 500°

C. temperature range. Additionally, TABLE 9A also indicates that J17/STELLITE-6® material pair exhibits similar wear resistance in comparison to the J130/STELLITE-6® and better wear resistance than J160/STELLITE-6® material pairs in the 250° C. to 500° C. temperature range.

TABLE 9B

| Temp | Materials Test Pairs | | | | | |
|---|---|---|---|---|---|---|
| | J17/NIMONIC-80A ® Materials Wear (mg) | | | J3/NIMONIC-80A ® Materials Wear (mg) | | |
| (° C.) | Disk | Pin | Total | Disk | Pin | Total |
| 200 | 2.0 | 2.5 | 4.5 | 0.7 | 2.9 | 3.6 |
| 250 | 1.1 | 0 | 1.1 | 1.3 | 3.5 | 4.8 |
| 300 | 1.8 | 0 | 1.8 | 0.9 | 3.9 | 4.8 |
| 350 | 1.8 | 0 | 1.8 | 1.1 | 1.4 | 2.5 |
| 400 | 1.2 | 0 | 1.2 | 1.9 | 3.4 | 5.3 |
| 450 | 1.8 | 0 | 1.8 | 1.5 | 3.7 | 5.2 |
| 500 | 1.2 | 0 | 1.2 | 1.5 | 0.1 | 1.5 |

As illustrated in TABLE 9B, the J17/NIMONIC-80® materials pair exhibited significantly improved wear resistance in comparison to the J3/NIMONIC-80A® materials pair in the 250° C. to 500° C. temperature range. However, for lower temperatures (≦200° C.), the J3/NIMONIC-80A® materials pair exhibited better wear resistance.

TABLE 9C

| Temp | Materials Test Pairs | | | | | |
|---|---|---|---|---|---|---|
| | J17/INCONEL-751 ® Materials Wear (mg) | | | J3/INCONEL-751 ® Materials Wear (mg) | | |
| (° C.) | Disk | Pin | Total | Disk | Pin | Total |
| 200 | 2.8 | 2.6 | 5.4 | 0.6 | 1.1 | 1.7 |
| 250 | 3.1 | 3.0 | 6.1 | 0.8 | 2.9 | 3.7 |
| 300 | 1.7 | 0 | 1.7 | 1.1 | 3.1 | 4.2 |
| 350 | 1.2 | 0 | 1.2 | 3.8 | 0.8 | 4.6 |
| 400 | 1.6 | 0 | 1.6 | 1.6 | 0 | 1.6 |
| 450 | 2.2 | 0 | 2.2 | 2.4 | 0 | 2.4 |
| 500 | 1.7 | 0 | 1.7 | 2.5 | 0 | 2.5 |

As illustrated in TABLE 9C, the J17/INCONEL-751® materials pair exhibited a significantly improved wear resistance in comparison to the J3/INCONEL-751® materials pair in the 300° C. to 500° C. temperature range. However, for lower temperatures (≦250° C.), the J3/INCONEL-751® materials pair exhibited better wear resistance.

TABLE 9D

| Temp | Materials Test Pairs | | | | | |
|---|---|---|---|---|---|---|
| | J17/ TRIBALOY T-400 ® Materials Wear (mg) | | | J10/TRIBALOY T-400 ® Materials Wear (mg) | | |
| (° C.) | Plate | Pin | Total | Plate | Pin | Total |
| 200 | 1.9 | 0.1 | 2.0 | 0.2 | 1.0 | 1.2 |
| 250 | 1.4 | 0.6 | 2.0 | 0.7 | 1.3 | 2.0 |
| 300 | 2.0 | 0.3 | 2.3 | 0.5 | 1.9 | 2.4 |
| 350 | 1.4 | 0.1 | 1.5 | 0.3 | 1.2 | 1.5 |
| 400 | 1.7 | 0.2 | 1.9 | 0.7 | 0.8 | 1.5 |
| 450 | 2.5 | 0 | 2.5 | 0.2 | 0.9 | 1.1 |
| 500 | 2.5 | 0 | 2.5 | 0.6 | 0.8 | 1.4 |

As illustrated in TABLE 9D, the J17/TRIBALOY T-400® materials pair exhibited similar wear resistance as the J10/TRIBALOY T-400® materials pair in the 250° C. to 400° C. temperature range.

Dimensional Stability Testing

Samples of the J17 alloy with the composition outlined in TABLE 6 were evaluated for cystallographic stability by measuring the dimensional changes of the sample valve seat inserts before and after exposure to an elevated temperature. The outer diameters (O.D.) of the valve seat insert samples were measured at two locations, spaced 180° apart. Valve seat insert samples of two different O.D.'s were tested, 2.38 inch and 1.66 inch. The valve seat insert samples were heated to about 650° C. (about 1200° F.) for 20 hours in a lab type electrical furnace. To eliminate oxidation on the surfaces of the valve seat insert samples, all samples were placed in a titanium coated stainless steel thin foil bag during heating. Maximum allowable change in O.D. size after heating is 0.00025" per inch of insert diameter. The results of the dimensional stability test are summarized in TABLES 10A and 10B.

TABLE 10A

| Sample (2.38" O.D.) | Hardness (HRC) | Average Size Change (in. × $10^3$) | Max. Allowable Change (in. × $10^3$) | Status (Pass/Fail) |
|---|---|---|---|---|
| 1 | 44.9 | 0.4 | 0.60 | Pass |
| 2 | 45.3 | 0.4 | 0.60 | Pass |
| 3 | 46.1 | 0.3 | 0.60 | Pass |
| 4 | 45.7 | 0.3 | 0.60 | Pass |
| 5 | 44.0 | 0.1 | 0.60 | Pass |

TABLE 10B

| Sample (1.66" O.D.) | Hardness (HRC) | Average Size Change (in. × $10^3$) | Max. Allowable Change (in. × $10^3$) | Status (Pass/Fail) |
|---|---|---|---|---|
| 1 | 45.6 | 0.1 | 0.42 | Pass |
| 2 | 44.7 | 0.3 | 0.42 | Pass |
| 3 | 44.7 | 0 | 0.42 | Pass |
| 4 | 43.6 | 0 | 0.42 | Pass |
| 5 | 44.6 | 0.4 | 0.42 | Pass |

From the dimensional stability test, it was determined that valve seat insert samples with O.D.'s of 2.38 inch and 1.66 inch were crystallographically stable after being heated at 1200° F. for 20 hours. Both groups of inserts from both heats were stable and below the allowable O.D. size change.

The J17 alloy can be optionally heat treated at a temperature from about 1300° F. to about 1500° F. for about 2 hours to about 10 hours to relieve internal stresses. The heat treatment can be carried out in an inert, oxidizing or reducing atmosphere (e.g., nitrogen, argon, air or nitrogen-hydrogen mixture), or in a vacuum.

Hot Hardness Evaluation

Samples of the J17 alloy with the composition outlined in TABLE 6 were evaluated for hot hardness at temperatures up to 1600° F. (871° C.) with the Vickers hardness testing technique using ASTM E92-82 (2003) (standard test method for Vickers hardness of metallic materials). Test samples were inserted into three different testing locations in a vacuum chamber, which was evacuated to a pressure of $10^{-5}$ Torr prior to heating. Three Vickers hardness impressions were made in each sample using a diamond pyramid indenter with a 10 kg load at room temperatures. In a vacuum environment, the 10 kg load was corrected by 885 grams, due to the additional load imparted by the vacuum, for a total load of 10.885 kg. The test samples were successively heated to 200° F., 400° F., 600° F., 800° F., 1000° F., 1400° F. and 1600° F. After the temperature was stabilized at each temperature, three impressions were made on each sample, for a total of nine impressions at each temperature. The results of the hot hardness test are summarized below in TABLE 11.

TABLE 11

| | Vickers Hardness (HV10) | | |
|---|---|---|---|
| Temp ° F. (° C.) | J17 | J3 (Co-Rich) | J10 (Co-Based) |
| 68 (20) | 467 | 719 | 750 |
| 200 (93) | 433 | 702 | 641 |
| 400 (204) | 377 | 643 | 620 |
| 600 (316) | 347 | 600 | 581 |
| 800 (427) | 323 | 555 | 544 |
| 1000 (538) | 309 | 532 | 550 |
| 1200 (649) | 279 | 483 | 547 |
| 1400 (760) | 227 | 389 | 458 |
| 1600 (871) | 148 | 221 | 242 |

From the hot hardness testing the J3 and J10 alloys are considerably harder than the J17 alloy. This reduction in hardness is beneficial in reducing manufacturing costs (e.g. machining and inspection), as well as minimizing valve wear in certain valve-train applications.

Preferably, the insert exhibits a decrease in hardness of 40% or less when heated from about room temperature to about 1000° F. For example, from TABLE 11, the insert exhibits an HV10 Vickers hardness from about 465 HV10 at about room temperature to about 310 HV10 at about 1000° F.

In another embodiment, the J17 alloy can be formed into a shaped components by powder metallurgy. For example, metal powders can be pressed into a shaped component and sintered at temperatures from about 2000° F. to about 2350° F., preferably in a reducing atmosphere.

The preferred embodiments are merely illustrative and should not be considered restrictive in any way. The scope of the invention is given by the appended claims, rather than the preceding description, and all variations and equivalents which fall within the range of the claims are intended to be embraced therein.

What is claimed is:

1. A cobalt-rich wear resistant and corrosion resistant alloy consisting of in weight %:

0.5 to 1.2% C;

0.6 to 2.1% Si;

17 to 24% Cr;

27 to 38.5% Fe;

1.4 to 20% W;

3.8 to 9.7% Mo;

less than 1% Ni;

up to 1.5% each of Ti, Al, Zr, Hf, Ta, V, Nb or Cu; and/or up to 0.5% each of Mg, B or Y;

balance Co.

2. The alloy of claim 1, wherein C is 0.5 to 0.9%, Si is 0.75 to 1.15%, Cr is 17.5 to 20.5%, Fe is 27.0 to 32.0%, W is 12.5 to 16.5% W, Mo is 6.25 to 8.25% and Ni is 0.45 to 1.00%.

3. The alloy of claim 1, having a microstructure free of primary carbides and comprising up to 50% by volume eutectic reaction phases in a solid solution matrix.

4. The alloy of claim 3, wherein the solid solution matrix is an αFe-αCo face-centered cubic solid solution with W, Cr and Mo as solute elements.

5. The alloy of claim 3, wherein the eutectic reaction products comprise a $(Co,Cr)_7(W,Mo)_6$ phase and an αFe-αCo phase.

6. A valve seat insert made of the alloy of claim 1.

7. The valve seat insert of claim 6, wherein C is 0.5 to 0.9%, Si is 0.75 to 1.15%, Cr is 17.5 to 20.5%, Fe is 27.0 to 32.0%, W is 12.5 to 16.5%, Mo is 6.25 to 8.25% and Ni is 0.45 to 1.00%, the Fe and Co being present in an Fe:Co ratio of 0.7 to 1.1.

8. The valve seat insert of claim 6, wherein the insert is a casting and the microstructure includes 40 to 60% by volume eutectic reaction phases in a solid solution matrix.

9. The valve seat insert of claim 6, wherein the insert has an as-cast hardness from about 47 to about 53 Rockwell C, a compressive yield strength from about 105 ksi to about 115 ksi at room temperature; and/or a compressive yield strength from about 70 ksi to about 90 ksi at 1000° F.

10. The valve seat insert of claim 6, wherein the insert has an ultimate tensile rupture strength from about 85 ksi to about 95 ksi at room temperature; and/or an ultimate tensile rupture strength from about 75 ksi to about 85 ksi at about 1000° F.

11. The valve seat insert of claim 6, wherein the insert exhibits a dimensional stability of less than about $0.25\times10^{-3}$ inches per inch of insert outside diameter (O.D.) after about 20 hours at about 1200° F.

12. The valve seat insert of claim 6, wherein:

(a) the insert exhibits an HV10 Vickers hardness from about 465 HV10 at about room temperature to about 310 HV10 at about 1000° F.; or (b) the insert exhibits a decrease in hardness of 40% or less when heated from about room temperature to about 1000° F.

13. A method of manufacturing an internal combustion engine comprising inserting the valve seat insert of claim 6 in a cylinder head of the internal combustion engine.

14. The method of claim 13, wherein the engine is a diesel engine.

15. A method of operating an internal combustion engine comprising closing a valve against the valve seat insert of claim 6 to close a cylinder of the internal combustion engine and igniting fuel in the cylinder to operate the internal combustion engine.

16. The method of claim 15, wherein the engine is a diesel engine.

17. The method of claim 15, wherein the valve:

(i) is composed of a high-temperature, nickel-chromium alloy strengthened by precipitation hardening; or a high-temperature, nickel-based superalloy; or (ii) the valve is hard-faced with a high temperature, wear-resistant cobalt-based alloy strengthened by carbides; or is hard-faced with a high-temperature, wear-resistant cobalt-based alloy strengthened by Laves phases.

18. A method of making a cobalt-rich wear resistant and corrosion resistant alloy comprising in weight %:

0.5 to 1.2% C;

0.6 to 2.1% Si;

17 to 24% Cr;

27 to 38.5% Fe;

1.4 to 20% W;

3.8 to 9.7% Mo;

less than 1% Ni;

balance Co;

wherein the alloy is:

(a) cast from a melt at a temperature of from about 2800° F. to about 3000° F.; or (b) pressed into a shaped component and sintered at a temperature from about 2000° F. to about 2350° F.

19. The method of claim 18, wherein the alloy is cast from a melt at a temperature from about 2875° F. to about 2915° F.; and further comprising heat treating the cast alloy at a temperature from about 1300° F. to about 1500° F. for about 2 to about 10 hours in an inert, oxidizing, reducing atmosphere or in a vacuum.

* * * * *